United States Patent [19]

Hanson et al.

[11] 4,398,761

[45] Aug. 16, 1983

[54] DEVICE FOR LIFTING AND TILTING CONCRETE PANELS

[75] Inventors: David W. Hanson, Golden Valley; Richard C. Nash, New Prague; Richard R. Koehn, Prior Lake, all of Minn.

[73] Assignee: Fabcon, Incorporated, Savage, Minn.

[21] Appl. No.: 289,712

[22] Filed: Aug. 3, 1981

Related U.S. Application Data

[63] Continuation-in-part of Ser. No. 169,048, Jul. 15, 1980, abandoned.

[51] Int. Cl.[3] ..... B66C 1/42

[52] U.S. Cl. ..... 294/81 R; 294/67 BB; 294/67 BC; 294/88; 414/783

[58] Field of Search ..... 294/63 R, 67 R, 67 B, 294/67 BA, 67 BB, 67 BC, 67 DB, 73, 78 R, 78 A, 81 R, 81 SF, 86 R, 86 LS, 88, 103 R, 104, 113; 414/419, 423, 425, 626, 783

[56] References Cited

U.S. PATENT DOCUMENTS

| | | | |
|---|---|---|---|
| 2,205,023 | 6/1940 | York | 294/73 |
| 3,161,431 | 12/1964 | Francis | 294/81 R X |
| 3,206,534 | 9/1965 | Vogele et al. | 294/63 R X |
| 3,685,667 | 8/1970 | Dempsey | 294/67 |
| 3,687,300 | 8/1972 | Andersson | 414/783 |
| 3,858,928 | 1/1974 | Gottlieb et al. | 294/81 |
| 3,899,205 | 8/1975 | Lanigan et al. | 294/81 |
| 3,976,205 | 8/1976 | Goransson | 414/783 |
| 3,980,190 | 10/1975 | Paterson | 214/383 |
| 3,983,926 | 10/1976 | Muller | 164/386 |
| 4,105,240 | 8/1978 | Steenson et al. | 294/81 R |
| 4,111,310 | 9/1978 | Stobb | 294/86 R X |
| 4,236,744 | 12/1980 | Reinders | 294/88 |

*Primary Examiner*—Johnny D. Cherry

*Attorney, Agent, or Firm*—Schroeder, Siegfried, Vidas & Arrett

[57] ABSTRACT

A device for both lifting and dumping of core material from long hollow core concrete panels. The device utilizes a pair of retractable clamp members to engage the longitudinal groove in the side of the panel.

23 Claims, 13 Drawing Figures

Fig. 3
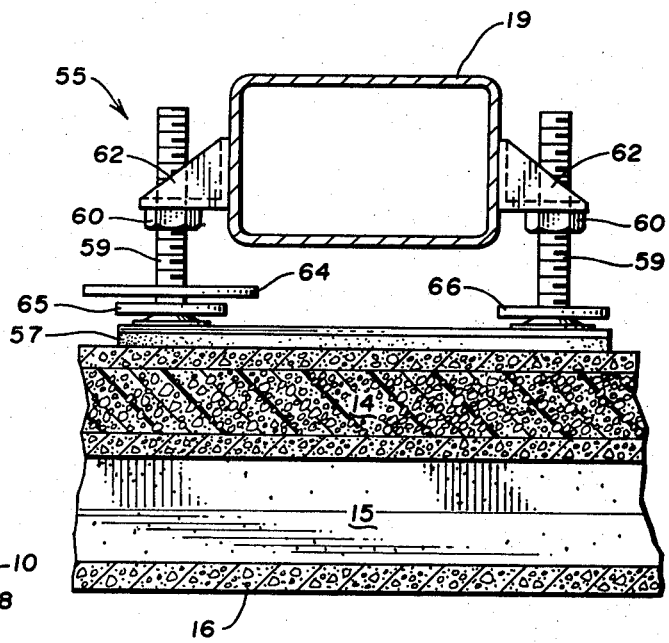
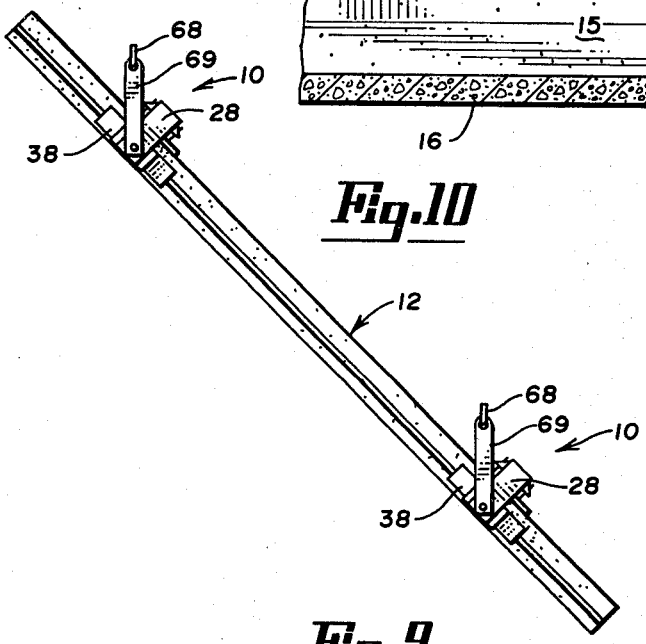
Fig. 10
Fig. 9
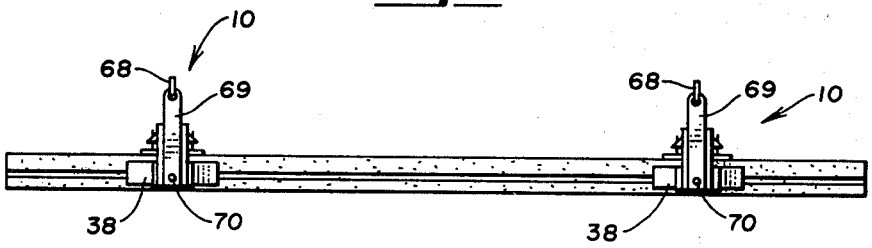

DEVICE FOR LIFTING AND TILTING CONCRETE PANELS

BACKGROUND OF THE INVENTION

This application is a continuation-in-part of patent application Ser. No. 169,048, filed July 15, 1980, now abandoned, entitled "Device for Lifting and Tilting Concrete Panels."

The present invention relates in general to devices for lifting and tilting long concrete panels.

In the manufacture of long concrete panels on elongated casting beds, one manufacturing step involves the removing of pieces of the cast concrete plank from the casting bed after the plank is cast and partially cured. One method of accomplishing this function, which was used in the prior art, was the insertion of lifting loops into the top surface of the panel. The lifting loops, formed of pieces of reinforcing bar or loops of prestressing cable, projected above the top surface of the panel and could be readily engaged by hooks suspended from a crane to permit the lifting of the planks.

In casting processes where hollow core planks are manufactured by a slipform technique to form voids by filling them with rocks or aggregate, it is necessary to dump the core material from the panels after they are removed from the casting bed. Although this operation can be done using prior art lifting loops, the loops are susceptible to pulling out of the surface during lifting and lifting loops must be removed from the top surface of the panel after the panel is installed. Covering the remnants of the lifting loops after the panel has been erected to form building walls is a high labor process that does not always produce satisfactory results.

Although lifting devices which do not require lifting loops have been developed for lifting large concrete panels from a casting bed, such lifting devices, as the one shown in U.S. Pat. No. 4,105,240, are useful primarily for lifting solid core panels because the clamping devices shown therein are unsuitable for both lifting and tilting hollow core planks to dump core material to form the voids.

SUMMARY OF THE INVENTION

Devices embodying the teachings of the present invention are suitable for lifting and tilting eight-foot wide hollow core concrete panels without using lifting loops and without damage to the panels.

The device utilizes a pair of clamping heads which are suspended from the opposite ends of an extendable beam. The clamping heads include a raised portion which can be inserted into the longitudinal groove along the sidewall of a typical panel. Each clamping head is pivotally mounted on the end of the beam so that its angle relative to the sidewall of the panel can be altered for ease of alignment. Spring retaining means hold the clamping heads in a retracted position until the extendable beam, from which the clamping heads are suspended, is retracted to bring the clamping heads into contact with the sidewalls of the panel.

In order to provide for tilting of the panel without applying high torques between the clamping head and the sidewall of the panel, a pivotal connecting means is employed to provide for rotation of the clamping head about an axis aligned with the point of contact between the clamping head and the sidewall of the panel. The pivotal connection of the clamping head to the extension of the cable from the overhead crane permits the plank to be tilted without applying twisting forces to the clamping head which would tend to damage the sidewalls of the panel and, in some cases, result in twisting the clamp away from the panel.

Alignment guides are provided on the extendable beam to vertically align the clamping heads with the longitudinal groove on the sidewalls of the panel to facilitate attaching the lifting clamp to the panel. An actuator is used to engage the clamping heads with the sidewalls of the panel and apply a positive compression force thereto to maintain the clamping head in a gripping relationship with the panel to permit the panel to be lifted and tilted as desired.

In contrast to the clamping device taught in the prior art, the panel can be lifted and tilted without applying, rotational forces to the clamping mechanism relative to the panel. Because the pivot point in prior art, such as shown in U.S. Pat. No. 4,105,240, is located a considerable vertical distance from the center of gravity of the panel, the clamp, when the panel is tilted, will apply a strong torque to the point of connection between the panel and the clamp tending to damage the panel and possibly to release the panel. In the clamp according to the present invention, the pivot point of the clamping head is aligned horizontally with or below the gripping point between the clamping head and the panel rather than being located above the panel as shown in prior art such as U.S. Pat. No. 4,105,240. This allows devices embodying the teachings of the present invention to be quite simply mechanized and allows the clamp to be rapidly connected to the panel that is desired to be lifted.

OBJECTS OF THE INVENTION

It is, accordingly, an object of the invention to provide a clamping device to permit the lifting and tilting of large cast concrete panels without using lifting loops cast into the surface of the panels.

It is a further object of the present invention to provide a clamp which can be easily applied to concrete panels to facilitate lifting and tilting the panels without damage thereto.

These and other objects and advantages of the present invention will become apparent to those skilled in the art from the detailed description of a preferred embodiment of the invention which follows and taken in conjunction with the accompanying drawings in which like parts are designated by the same reference numerals.

BRIEF DESCRIPTION OF THE DRAWINGS

FIG. 3 is a partial section view taken along line 3—3 of FIG. 2 showing the alignment guides utilized to position the clamp prior to engagement with the panel;

FIGS. 9 and 10 are side views of devices embodying the teachings of the present invention supporting a panel in horizontal and tilted positions, respectively.

DETAILED DESCRIPTION OF THE PREFERRED EMBODIMENTS OF THE INVENTION

Figure 1:
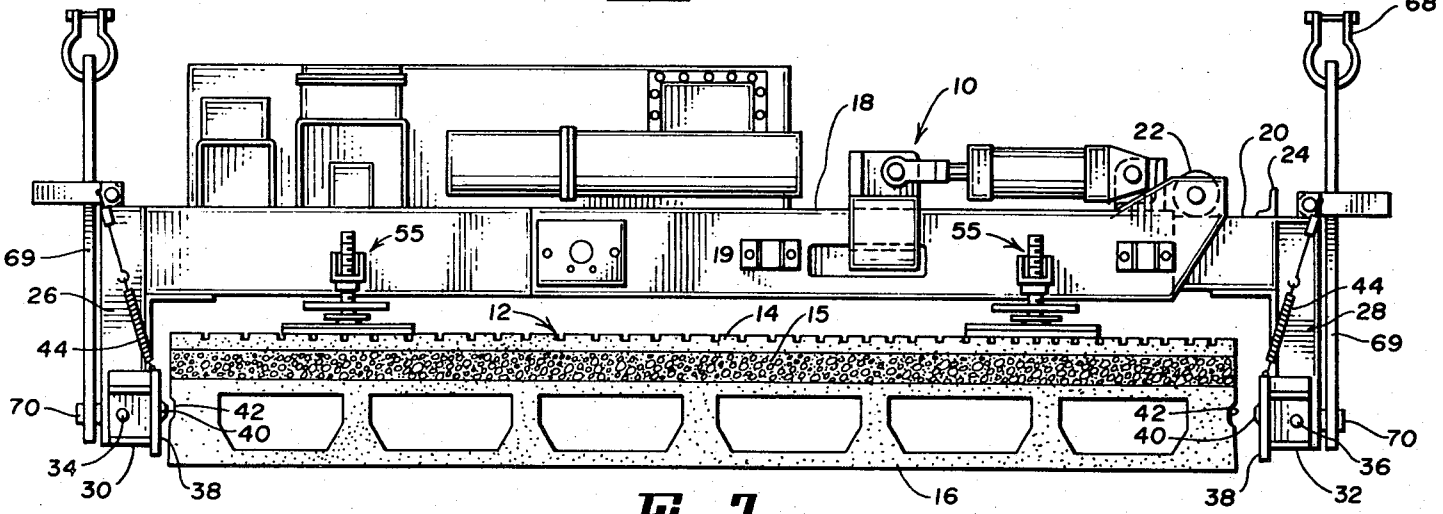
FIGS. 1 and 2 are elevation views of the clamp according to the present invention positioned prior to engagement and subsequent to engagement with the panel respectively.
Figure 2:
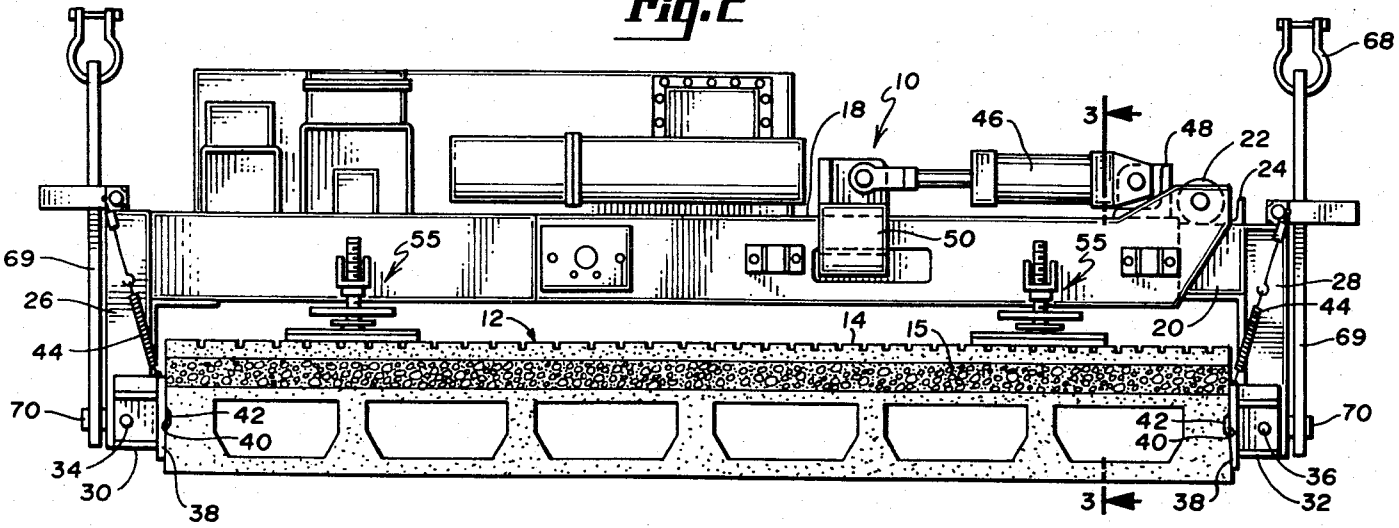
Figure 4:
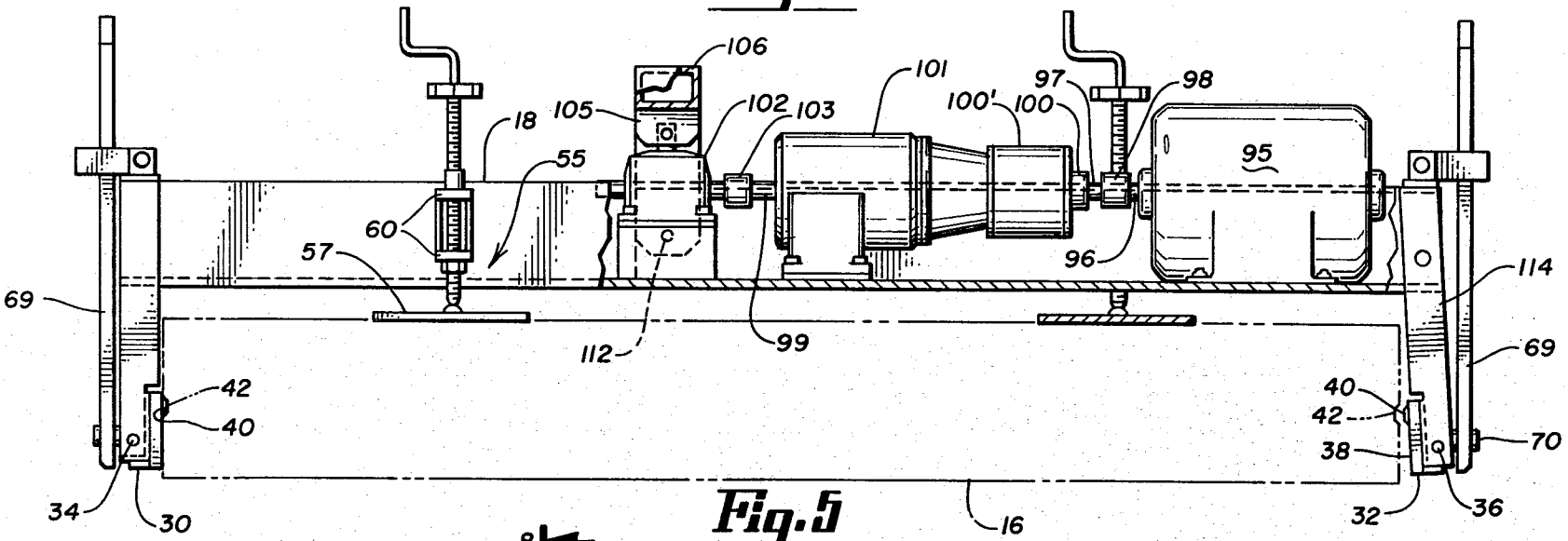
FIGS. 4 and 5 are side elevation views of an alternate embodiment of a clamp according to the present invention positioned prior to engagement and subsequent to engagement with the panel, respectively, with parts cut away and the concrete slab profile in phantom line.
Figure 5:
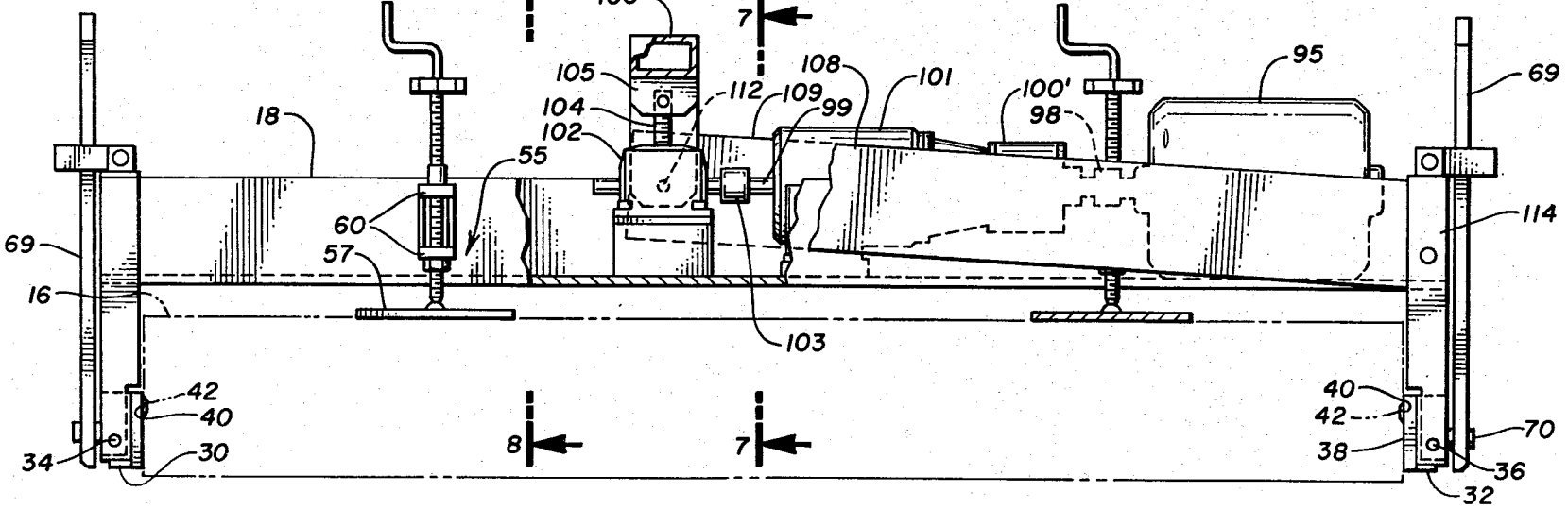

FIGS. 1 and 2 show a first embodiment of the invention. A clamp 10 is positioned above a panel 12 which, in the embodiment shown, is a sandwich panel having a decorative textured top surface 14, an insulating layer 15 formed from polystyrene foam or some similar insulating material and a structural base portion 16 which is a hollow core prestressed plank. In FIG. 1, the lifting clamp 10 is shown in the disengaged position, while, in FIG. 2, the clamp is shown in the engaged position with panel 12. The lifting clamp can be applied to lift panels after they have been cast and partially cured and can remove the plank either from the surface of a casting bed or from a suitable nonraised storage pallet. Because the lifting clamp, according to the present invention, does not project below the bottom face of the panel, the clamp can be engaged with the panel even when it is sitting on a flat surface such as a truckbed or railroad flatcar. Thus, the clamp can be placed in lifting and tilting engagement with the panel in one operation rather than a two-step process shown in prior art, such as U.S. Pat. No. 4,105,240, where the panel is initially lifted using side forces only and then is placed on a pallet while supporting brackets are positioned under the panel.

Clamping device 10 is comprised of an extendable beam 18 comprised of an outer beam section 19 and an inner beam section 20, which is mounted for movement in and out of beam 19 along the axis of the beam. The movement of beam 20 relative to beam 19 is slidable movement which is facilitated using a roller 22 which is rotatably mounted at one end of beam 19. A stop or detent 24 is mounted on beam 20 to prevent inadvertent retraction of the entirety of beam 20 into beam 19 to avoid possible damage to the clamp or its control system.

The retractable beam 18 has downwardly projecting end portions 26 and 28 attached to beams 19 and 20, respectively. Portions 26 and 28 are not movable relative to the beam portions 19 and 20 to which they are attached, and provide a rigid support frame to which clamping heads 30 and 32 are pivotally mounted on shafts or pins 34 and 36, respectively. The face 38 of clamping heads 30 and 32 includes a projecting portion 40 to permit the clamping head to directly engage the longitudinal slot 42 along the sidewall of panel 12. The panel 12 shown has a sidewall which is not vertical. To permit face 38 of the clamping heads 30 and 32 to be positioned against the sidewall of panel 12, limited pivotal movement of the heads about axes 34 and 36 is permitted relative to the downwardly depending extensions 26 and 28 of beams 19 and 20. The clamping heads are maintained in a neutral, usually vertical orientation by springs 44 as the clamping heads are brought into alignment with the sidewalls of panel 12.

The extendable beam 18 shown in FIG. 1 is retracted by operation of a hydraulic actuator 46 which is connected to a projection 48 of beam 19 at one end and to a projection 50 of beam 20 at the other end. When actuator 46 is extended as shown in FIG. 2, the inner beam 20 is moved from right to left to reduce the distance between the faces 38 of clamping heads 30 and 32 and bring them into firm engagement with the sidewalls of panel 12 as shown in FIG. 2. Alignment guides 55 are utilized to vertically align and level the extendable beam 18 with the top surface 14 of panel 12. When the alignment guides 55 are utilized to preselect the proper vertical height of the extendable beam 18 over the surface of panel 12, the projection 40 on the face 38 of clamping heads 30 and 32 will be in proper engagement with the longitudinal groove 42 cast into the sidewall of panel 12 during the manufacturing step. The pivotal connection between clamping heads 30 and 32 and the downwardly projecting members 26 and 28 allows alignment of the face 38 of the clamping members with the non-vertical sidewalls of panel 12.

Figure 11:
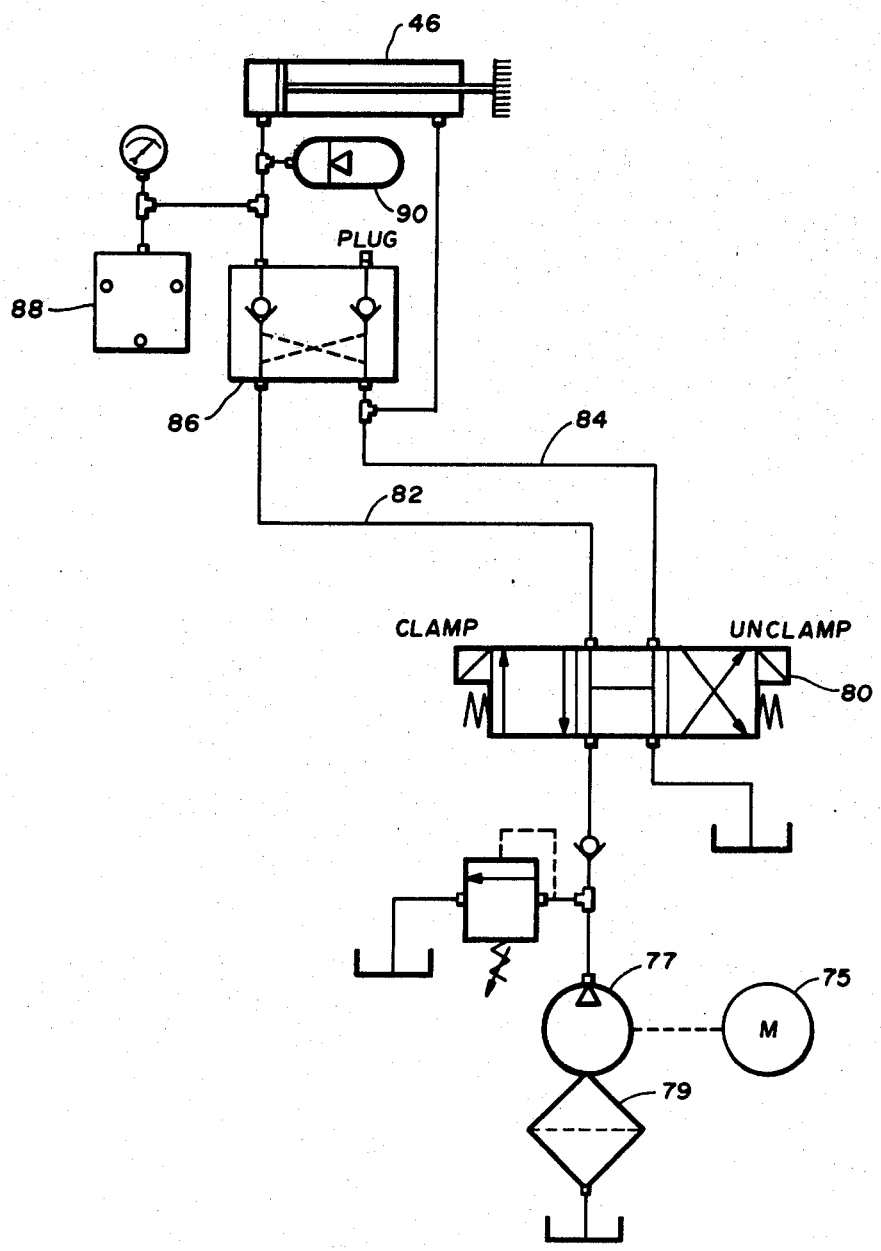
FIGS. 11 and 12 are hydraulic and electrical schematics of the controls used to operate the clamp shown in FIGS. 1 through 3.
Figure 12:
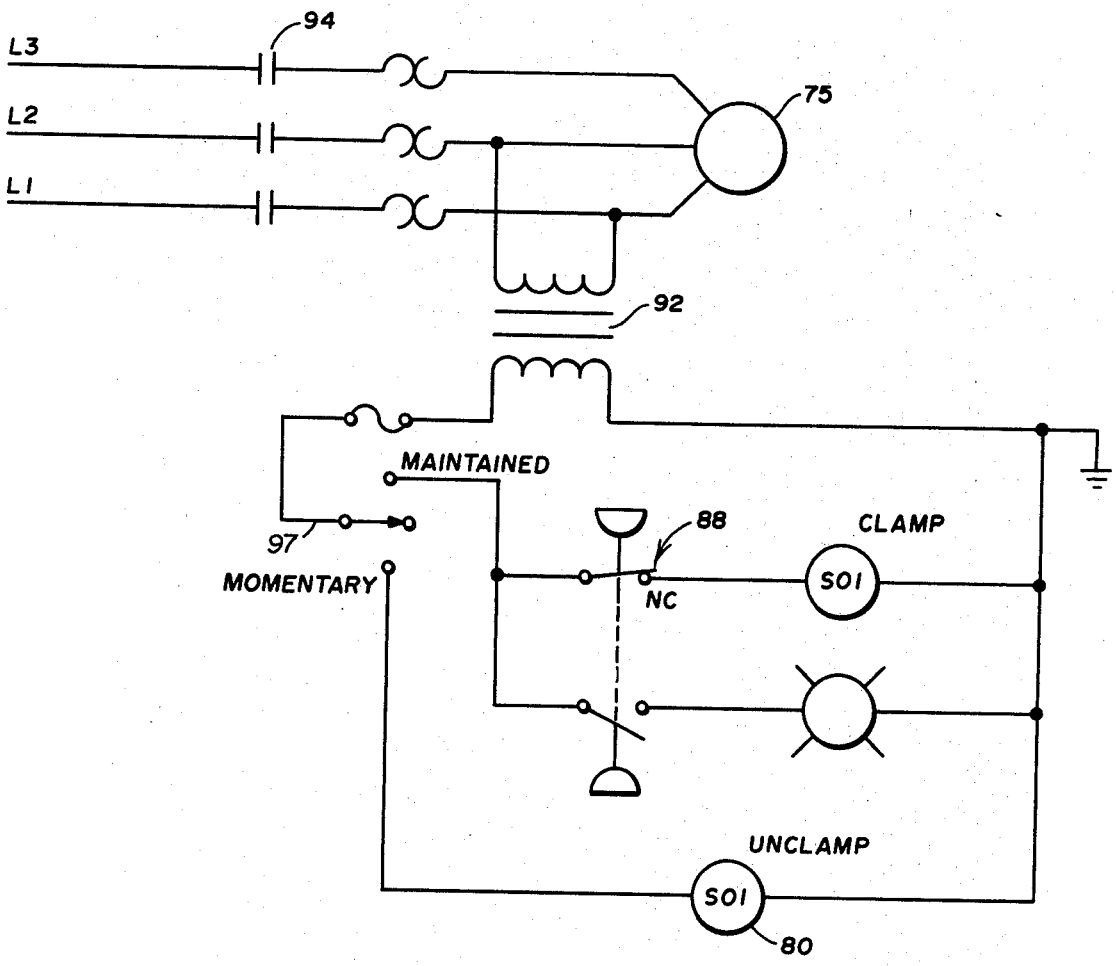

FIG. 3 shows, in additional detail, the structure of one embodiment of the alignment guides 55. The alignment guides are comprised of a positioning pad 57 attached to a pair of threaded vertical uprights 59 which are screwed into threaded fittings 60 attached to a frame 62 which is welded to beam 19. The alignment guides 55 assure the proper vertical alignment of the lifting clamps above the surface of the panel to be lifted and assure a proper initial rotational alignment of the clamp to assure proper alignment of the projection 40 on the gripping face 38 of the clamping head as the panel is engaged. The control means shown in FIGS. 11 and 12 are used to operate actuator 46 to retract extendable beam 18 and force clamping heads 30 and 32 into gripping contact with the sidewalls of panel 12.

In the embodiment shown in FIG. 3, adjustment of the positioning pad 57 of the alignment device 55 can be accomplished by rotation of adjusting wheel 64 which is attached to one of the vertical shafts 59. Rotation of the shaft to which wheel 64 is attached can be transmitted to the other threaded shaft by means of sprockets 65 and 66 attached to each of the shafts and interconnected by a conventional chain 67 which is not explicitly shown in FIG. 3, but is visible in the alternate embodiment shown in FIG. 6.

Figures 6, 7, 8, 13:
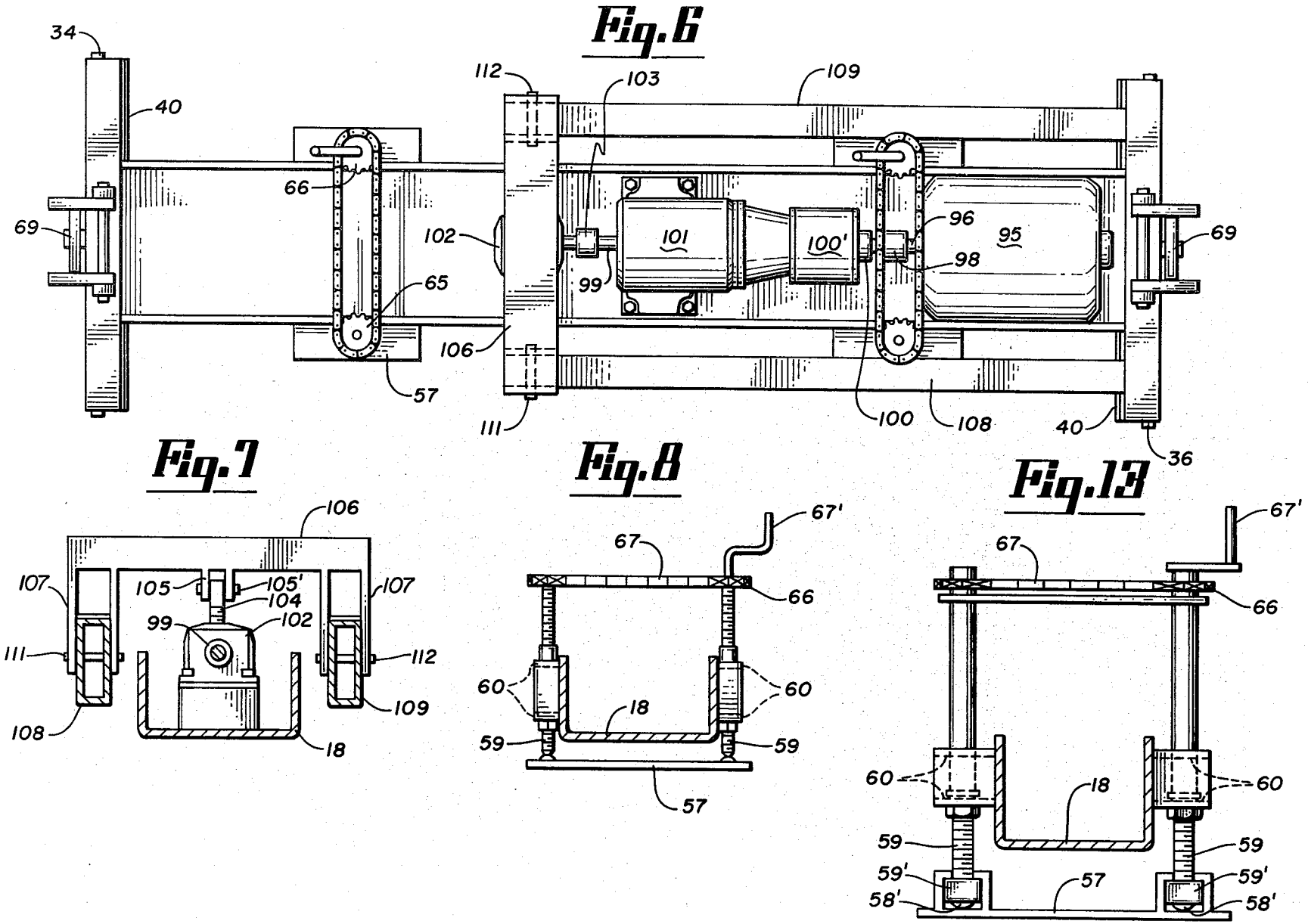
FIG. 6 is a top plan view of the alternate embodiment of the clamp.
FIGS. 7 and 8 are side elevations taken along lines 7—7 and 8—8, respectively, of FIG. 5.
FIG. 13 is a side elevation view of an alternate embodiment of the alignment guide structure shown in FIGS. 3 and 8.

A first alternative embodiment of an alignment guide is shown in FIG. 8, and a second alternative embodiment is shown in FIG. 13. In both embodiments, a crank 67′ is used to rotate one of the threaded rods 59 to alter the initial height of the clamp device as the alignment device is brought into contact with the surface of a plank which is to be lifted.

The second alternative alignment guide, shown in FIG. 13, includes an improvement which lessens the possibility of damage to the alignment guides as the clamping device is operated. A ball bearing 58′ is positioned at the end of each of the threaded rods 59 using a suitable retainer 59′ directly attached to each of the rods 59. The positioning pad 57 in this embodiment includes a box on its upper surface to receive and enclose the ball bearing 58 and retainer 59′ and allow for movement of the ball bearing 58′ relative to pad 57 to prevent bending moment forces from being transmitted to the threaded support rods 59.

FIGS. 4 through 8 show an alternate embodiment of the invention. In the Figures, similar elements have been given the same reference characters that they were given in the hydraulically actuated embodiment shown in FIGS. 1 through 3.

In the alternate or second embodiment, the clamp device is extended and retracted by an electrical motor 95 which may be of any commercially available type providing a high torque output and capable of withstanding a substantially continuous stall operating condition. Conventional circuitry may be used to control motor 95.

The output shaft 96 is coupled to a shaft input to a modular input unit 100, model number MIU-875, manufactured by Horton Manufacturing Co., Inc., through a $\frac{7}{8}$th-inch to 1-$\frac{5}{8}$th-inch chain coupling 98. A double C flange brake 100' is connected to a helical speed reducer such as the Winsmith 6YHDC speed reducer 101 and its output shaft is connected to the input shaft of a screw jack 102 through a 1-inch to 1-$\frac{1}{4}$-inch chain coupling 103. The screw 104 of the screw jack 102 is pinned to a clevis 105 depending from a beam 106 as can best be seen in the cross-section diagram in FIG. 7.

The clevis pin 105 is a load sensing clevis pin as manufactured by Strainsert, Inc., of West Conshohocken, Pa. 19428. The load sensing clevis pin is a strain gauge transducer which includes one or more strain gauges to sense the shear force on the pin in a specified direction. Use of a load sensing clevis pin 105 permits the user of the clamp to indirectly measure the force applied by the clamps against the plank. In actual operation, it has been found that a clamping force of 24,000 to 30,000 pounds provides a reliable operation of the clamp. Conventional control circuitry, not shown, stops motor 101 from further advancing the jackscrew when the predetermined force threshold is reached.

Beam 106 has a clevis 107 on each end, one of which is pinned to beams 108 and 109 by pins 111 and 112, respectively. The other ends of beams 108 and 109 are rigidly connected to one end of an arm 114 which is connected at its other end to a clamping head 32 by means of a pin 36. Clamping head 32 has limited pivotal movability about the axis of pin 36.

Arm 114 is suspended from beams 108 and 109 at an obtuse angle of about 93° so that clearance is maintained between the face of clamping head 32 and the side of the panel when jack 102 is retracted and beams 108 and 109 are aligned with the fixed beam 18 when jack 102 is in the retracted position. This permits the operator to position the clamping apparatus over a panel and engage the fixed clamping head 30 with the side slot 42 of one side of the panel. Clamping head 32 is then brought into engagement with its side of the panel by actuating motor 95 by conventional circuitry not shown to operate jack screw 102 through reducer 96. As beam 106 is elevated, beams 108 and 109 are pivoted clockwise as viewed in FIGS. 4 and 5 to move clamping head 32 into position to engage slot 42 and grip the plank.

FIGS. 9 and 10 show two clamps according to the present invention being utilized to lift a panel 12 and to tilt it. In order to provide for the lifting and tilting without applying a large torque to the clamping head as it engages the side of the panel, the point of connection between the clamping head and the link 69 connected to the overhead crane must be located at or below the center of the area of contact between the face 38 of the clamping head to the sidewall of panel 12. In the preferred embodiment shown, this is accomplished by a link 69 pivotally connected to beam projections 26 and 28. The clamping means is rotatable relative to links 69 about an axis defined by pin 70. That axis is through or preferably below the center of gravity of the panel to be lifted. The maximum amount that the panel can be tilted in the dumping process is not an inherent limitation of the structure of clamp 10, but is determined by the length of the panel 12 being lifted and the nature of the structure supporting the clamp from above. If the crane supporting the cables 68 is capable of placing those cables nearly coaxially, the maximum angle that the panel can be rotated from the horizontal approaches 85°.

FIG. 11 is a schematic of the hydraulic controls for the clamp and FIG. 12 shows the electrical controls. In FIG. 11, the hydraulic actuator 46 is shown driven by a motor 75 which, in turn, drives a pump 77 which has a two-gallon hydraulic reservoir 79. The output of reservoir 79 passes through an electrically controlled solenoid 80. The hydraulic lines 82 and 84 are connected to actuator 46. Hydraulic line 82 passes through a check valve 86. A pressure switch 88 measures the pressure on line 82 at the input to actuator 46. Accumulator 90 provides, in the preferred embodiment shown, a precharge pressure of 1800 psi.

Referring now to FIG. 12, the electrical schematic of the first embodiment as shown in FIGS. 1 through 3, the motor 75 is shown driven by a three phase AC line. A transformer 92 provides a step down voltage to operate solenoid 80. When the clamping device is desired to be actuated, the starter switch 94 is closed to start the pump which continues to run. In order to engage the clamping heads, the selector switch 97 is switched to the "maintained" position and the solenoid 80 changes to the "clamp" position to drive hydraulic fluid into the cylinder of actuator 46 to force the piston out of the cylinder and engage the clamping head by retracting beam 20 into beam 19. To unclamp the device, the selector switch is moved to the "momentary" position in FIG. 12 and held. Solenoid 80 moves to the "unclamp" position and the piston is retracted into the cylinder.

We claim:

1. Apparatus for lifting concrete panels, said apparatus including two or more lifting clamps, each of which comprises:

a first beam;

a second beam;

a first clamping head rigidly connected to said first beam; said first clamping head constructed and arranged to engage said panel on one sidewall thereof;

a second clamping head rigidly connected to said second beam, said second clamping head constructed and arranged to engage said panel on an opposite sidewall thereof;

means for moving said first beam relative to said second beam to selectively engage and disengage one or both of said clamping heads from the sidewall of said panel; and connection means connected to said apparatus and constructed and arranged for connection to a lifting cable, said connection means providing for pivotal movement of said apparatus and said first and second clamping heads about an axis through said panel below said beams.

2. Apparatus for suspension from lifting cables depending from an overhead crane, said apparatus constructed and arranged to lift and tilt concrete panels, said apparatus including two or more lifting clamps, each of which comprises:

a pair of extendable beams;

a pair of clamping heads, one each of which is suspended from one end of each of said pair of extendable beams, each one of said pair of clamping heads constructed to engage said panel on a sidewall thereof;

connection means connected to said apparatus and said lifting cable, said connection means providing for pivotal movement of said apparatus and said pair of clamping heads about an axis through said panel below said pair of extendable beams; and means for extending and retracting said pair of extendable beams relative to each other to position said pair of clamping heads to grip said panel on adjacent sides.

3. The invention of claim 2 wherein said pair of beams includes alignment guide means for setting the vertical height of said beams above the surface of said panel and for establishing the desired angular alignment of said lifting clamps to facilitate engagement of said clamping heads with the sidewalls of said panels.

4. The invention of claim 3 wherein each of said alignment guide means comprises:

alignment plate means; and linking means attached to one of said pair of beams and to said alignment plate means, said linking means is constructed and arranged for adjustable movement of said alignment plate means for controlling the alignment and vertical spacing of said lifting clamps relative to the surface of said concrete panels.

5. The invention of claim 4 wherein said linking means comprises:

at least one threaded rod rotatably attached to one end thereof to said alignment plate means;

receiving means mounted on one of said beams, including a threaded opening therein for receiving one of said threaded rods; and means for introducing relative movement between said threaded rod and the threaded portion of said receiving means and thereby raising and lowering said alignment plate means.

6. The invention of claim 5 wherein said threaded rod has a ball bearing attached to one end thereof and wherein said alignment plate means includes means for engaging the end of said threaded rod and for permitting rolling movement of said rod relative to said alignment plate means and the surface of said plank panel.

7. The invention of claim 5 wherein said threaded rod has a ball bearing attached to one end thereof and wherein said alignment plate means includes means for engaging the end of said threaded rod and for permitting rolling movement of said rod relative to said alignment plate means and the surface of said panels.

8. The invention of claim 4 wherein said pivotally mounted clamping heads are spring biased to a normal position and move to a gripping position against the sidewalls of said panel as said pair of extendable beams is retracted.

9. The invention of claim 2 wherein said pair of clamping heads are pivotally mounted on said pair of extendable beams to facilitate alignment with non-vertical sidewalls of said panel.

10. The invention of claim 2 wherein the engagement face of said pair of clamping heads includes a projecting portion to engage a longitudinal groove in the sidewall of said panel.

11. The invention of claim 2 wherein said connection means is a link pivotally connected at one end to one of said pair of extendable beams with the other end of said link connected to the cable suspended from said overhead crane.

12. The invention of claim 2 wherein said means for extending and retracting said pair of extendable beams to position said pair of clamping heads comprises hydraulically actuated means constructed and arranged to apply a positive clamping force on said pair of clamping heads to forceably grip the sidewalls of said panel.

13. Apparatus for suspension from lifting cables depending from an overhead crane, said apparatus constructed and arranged to lift and tilt concrete panels, said apparatus including two or more lifting clamps, each of which comprises:

an extendable beam;

a pair of clamping heads suspended from each end of said extendable beam, each of said clamping heads constructed to engage said panel on a sidewall thereof;

connection means connected to said apparatus and said lifting cable, said connection means providing for pivotal movement of said apparatus and said pair of clamping heads about an axis through said panel below said beam; and means for extending and retracting said beam to position said pair of clamping heads to grip said panel on adjacent sides.

14. Apparatus for suspension from lifting cables depending from an overhead crane, said apparatus constructed and arranged to lift and tilt concrete panels, said apparatus including two or more lifting clamps, each of which comprises:

a pair of beams;

a pair of clamping heads, one each of which is suspended from one end of each of said pair of beams, each one of said pair of clamping heads constructed to engage said panel on a sidewall thereof;

connection means connected to said apparatus and said lifting cable, said connection means providing for pivotal movement of said apparatus and said pair of clamping heads about an axis through said panel below said pair of beams; and means for moving said pair of beams relative to each other to position said pair of clamping heads to grip said panel on adjacent sides.

15. The invention of claim 14 wherein said pair of beams includes alignment guide means for setting the vertical height of said beams above the surface of said panel and for establishing the desired angular alignment of said lifting clamps to facilitate engagement of said clamping heads with the sidewalls of said panels.

16. The invention of claim 15 wherein each of said alignment guide means comprises:

alignment plate means; and linking means attached to one of said pair of beams and to said alignment plate means, said linking means is constructed and arranged for adjustable movement of said alignment plate means for controlling the alignment and vertical spacing of said lifting clamps relative to the surface of said concrete panels.

17. The invention of claim 16 wherein said linking means comprises:

at least one threaded rod rotatably attached at one end thereof to said alignment plate means;

receiving means mounted on one of said beams, including a threaded opening therein for receiving one of said threaded rods; and means for introducing relative movement between said threaded rod and the threaded portion of said receiving means and thereby raising and lowering said alignment plate means.

18. The invention of claim 14 wherein one each of said pair of clamping heads are pivotally mounted on one of said pair of beams to facilitate alignment with non-vertical sidewalls of said panel.

19. The invention of claim 18 wherein said pair of clamping heads are spring biased to a normal position and move to a gripping position against the sidewalls of said panel as said pair of beams are retracted.

20. The invention of claim 14 wherein said clamping head includes an engagement face having a projecting portion to engage a longitudinal groove in the sidewall of said panel.

21. The invention of claim 14 wherein said connection means is a link pivotally connected to one end of each beam of said pair of extendable beams with the other end of each of said links connected to the cable suspended from said overhead crane.

22. The invention of claim 14 wherein said means for moving said pair of beams relative to each other comprises jack screw means attached to the other ends of each of said beams of said pair of beams, said jack screw means constructed and arranged to apply a positive clamping force on said pair of clamping heads to forceably grip the sidewalls of said panel.

23. Apparatus for suspension from lifting cables depending from an overhead crane, said apparatus constructed and arranged to lift and tilt concrete panels, said apparatus including two or more lifting clamps, each of which comprises:

first and second beams, each of which has a clamping head suspended from one end thereof for engagement with opposite sidewalls of said panel;

means connected between said first beam and the other end of said second beam for elevating the end of said second beam relative to said first beam to selectably pivot said second beam and clamping head suspended from it into and out of engagement with sidewalls of said panel; and connection means connected to said apparatus and said lifting cable, said connection means providing for pivotal movement of said apparatus and said clamping heads about an axis through said panel below said first and second beams.

* * * * *